United States Patent [19]

Minh et al.

[11] Patent Number: 4,464,234

[45] Date of Patent: Aug. 7, 1984

[54] PRODUCTION OF ALUMINUM METAL BY ELECTROLYSIS OF ALUMINUM SULFIDE

[75] Inventors: Nguyen Q. Minh, Woodridge, Ill.; Raouf O. Loutfy, Tucson, Ariz.; Neng-Ping Yao, Clarendon Hills, Ill.

[73] Assignee: The United States of America as represented by the United States Department of Energy, Washington, D.C.

[21] Appl. No.: 364,282

[22] Filed: Apr. 1, 1982

[51] Int. Cl.[3] ..... C25C 3/06; C25C 3/18

[52] U.S. Cl. ..... 204/67

[58] Field of Search ..... 204/67

[56] References Cited

U.S. PATENT DOCUMENTS 4,039,648 8/1977 Haupin et al. ..... 423/496

FOREIGN PATENT DOCUMENTS 63995 7/1892 Fed. Rep. of Germany ..... 204/67
68909 5/1893 Fed. Rep. of Germany ..... 204/67
141310 8/1961 U.S.S.R. ..... 204/67

OTHER PUBLICATIONS

Canadian Chem. & Met. (Jun. 1934) p. 141.
Rontgen et al., Abhandlungen Institut für Metallhuttenwesen und Elektrometallurgie der Technischen Hochschule, Aaachen, vol. V, 1940.

*Primary Examiner*—Howard S. Williams
*Attorney, Agent, or Firm*—William Lohff; James W. Weinberger; Michael F. Esposito

[57] ABSTRACT

Production of metallic aluminum by the electrolysis of $Al_2S_3$ at 700°-800° C. in a chloride melt composed of one or more alkali metal chlorides, and one or more alkaline earth metal chlorides and/or aluminum chloride to provide improved operating characteristics of the process.

8 Claims, 3 Drawing Figures

PRODUCTION OF ALUMINUM METAL BY ELECTROLYSIS OF ALUMINUM SULFIDE

CONTRACTUAL ORIGIN OF THE INVENTION

The United States Government has rights in this invention pursuant to Contract No. W-31-109-ENG-38 between the U.S. Department of Energy and the University of Chicago representing Argonne National Laboratory.

BACKGROUND OF THE INVENTION

This invention relates to an electrolysis process for producing metallic aluminum from aluminum sulfide and to a molten bath in which the electrolysis is carried out.

Traditionally, metallic aluminum has been produced by the established Hall-Héroult process in which aluminum oxide is electrolyzed in a cryolite bath to the metallic form. Typical conditions include a voltage of about 4.5 volts, a current efficiency of about 90%, and an operating temperature of about 900°–1000° C. In the process, carbon anodes are consumed and require periodic replacement. Since this process has required large quantities of energy to carry out the electrolysis and provide the high operating temperatures, increasing costs for electrical power and other forms of energy have caused economic difficulties to aluminum producers.

Efforts have been made by various organizations to develop alternative processes with reduced energy requirements. One process utilizes anhydrous aluminum chloride in place of aluminum oxide in the electrolysis bath and operates at a reduced voltage of about 3.3 volts (at current density of about 0.8 A/cm$^2$), a current efficiency in the order of about 90% and an operating temperature of about 750° C. In this process, the electrolysis of aluminum chloride is carried out in a chloride melt containing one or more alkali metal chlorides to produce the metallic aluminum. Additives for particular purposes such as magnesium chloride in an amount of about 1 mol % (as reported in U.S. Pat. No. 3,755,099) may also be present. It has been estimated that this process provides an electrical energy saving in the order of about 30% over the same costs for the traditional process using aluminum oxide.

Although these savings in electrical energy have been impressive, the requirement of synthesizing about 5 kg of anhydrous aluminum chloride per kg of aluminum makes new processes with reduced energy requirements desirable, particularly in view of the overall large energy requirement. In the efforts to develop new processes, other sources of aluminum such as aluminum sulfide where only 2.8 kg of sulfide is required per kg of aluminum have been evaluated. While aluminum sulfide may be electrolyzed to form metallic aluminum, previous experimental efforts to carry out the process have not been characterized by satisfactory results. In some instances with baths containing fluoride melts from molten cryolite, current efficiencies have been in the order of 5%. With baths containing alkali metal chloride melts, the aluminum sulfide is only slightly soluble which limits the usefulness of the process. In addition, some experiments have resulted in products other than metallic aluminum or elemental sulfur. Therefore, an improved electrolysis process and an improved bath for producing metallic aluminum from aluminum sulfide are desirable.

One object of this invention is an electrolysis process utilizing aluminum sulfide as a source of aluminum. A second object is a process for producing metallic aluminum with reduced energy requirements. Another object is a process utilizing a bath with improved solubility for aluminum sulfide. Still another object is an aluminum sulfide process with improved current efficiencies in the order of at least 70%. Yet another object is an aluminum sulfide process with higher current densities. An additional object is an aluminum sulfide process with reduced problems from undesirable products. Additional objects, advantages, and novel features of the invention will be set forth in part in the description which follows, and in part will become apparent to those skilled in the art upon examination of the following or may be learned by practice of the invention.

SUMMARY OF THE INVENTION

Briefly, the invention relates to an electrolysis process for producing metallic aluminum from aluminum sulfide utilizing an electrolysis bath having an operating temperature of about 700°–800° C. and prepared from aluminum sulfide, and a chloride melt composed of one or more alkali metal chlorides and a chloride component selected from an alkaline earth metal chloride or chlorides or aluminum chloride or mixtures of these chlorides, with the chloride melt having a melting temperature below the operating temperature of the bath. The invention is further directed to the bath for use in an electrolysis cell which is operated at a voltage below about 3.9 volts (at current density of less than 1 A/cm$^2$) to produce metallic aluminum and a sulfur containing gas which is normally elemental sulfur with minor amounts of sulfur dioxide. Graphite electrodes may be utilized with limited if any attack by oxygen since the voltage is below the oxygen decomposition voltage.

The bath is characterized by improved solubility of the aluminum sulfide with values usually being in the range of about 2–10 mol % based on a melt containing sodium chloride, potassium chloride, magnesium chloride, and aluminum chloride. Advantageously, the bath is further characterized by an alkali metal chloride present in an amount of about 20–70 mol %, an alkaline earth metal chloride present in an amount of about 20–60 mol %, and aluminum chloride present in an amount of about 1–10 mol %. In addition, the electrolysis cell is operable with a current efficiency in the order of at least about 70% at a voltage of about 2.0–2.5 volts (at a current density of about 0.6 to 0.8 A/cm$^2$). By the use of aluminum sulfide, power requirements could be reduced by a calculated value in the order of about 25% from the requirements for the aluminum chloride process. Further, the invention permits the utilization of a bipolar cell with improved performance characteristics.

DETAILED DESCRIPTION OF THE INVENTION

The process and molten bath of this invention utilize a chloride melt for the electrolysis of aluminum sulfide. The chloride melt contains or is prepared from one or more alkali metal chlorides and a chloride component selected from the group consisting of one or more alkaline earth metal chlorides, aluminum chloride and mixtures of the components. While the composition may include certain other combinations such as AlSCl, it is to be understood for convenience that the composition will be described with reference to the original components. The combination of the chloride component with the alkali metal chloride or chlorides tends to increase the solubility of the aluminum sulfide in the melt and the acidity of the melt, the latter property tending to reduce the likelihood of forming polysulfides as a product which may interfere with production of metallic aluminum. Advantageously, aluminum chloride is present to increase the concentration of aluminum in the melt since this permits an increase in current density without creating conditions which will form a second metal such as magnesium.

Suitable alkali metal chlorides include the chlorides of sodium, potassium, lithium, cesium, and rubidium and preferably sodium, lithium and potassium. Suitable alkaline earth metal chlorides include the chlorides of magnesium, calcium, barium, and strontium and preferably magnesium. Suitable amounts of the components in the bath are about 2–10 mol % and preferably about 3 mol % of aluminum sulfide, about 20–60 mol % and preferably about 20–40 mol % of the alkali metal chloride or chlorides, about 20–70 mol % and preferably about 40–60 mole % of the alkaline earth metal chloride or chlorides and at least about 1 mol % and preferably about 1–10 mol % of aluminum chloride. Baths with compositions within these ranges have been found to provide current efficiencies of at least about 70% and usually in the order of 70–90% in the electrolysis process.

In the electrolysis process of the invention, the molten bath is prepared from aluminum sulfide, the alkali metal chloride or chlorides, and the chloride component composed of one or more alkaline earth metal chlorides, aluminum chloride, or mixtures of these chlorides. When the chloride component is alkaline earth metal chloride, at least about 20 mol % is present in the composition and when aluminum chloride is the component, at least about 1 mol % is present. Advantageously, the concentration of chloride melt is selected to provide a low melting composition and preferably a eutectic.

Figure 1:
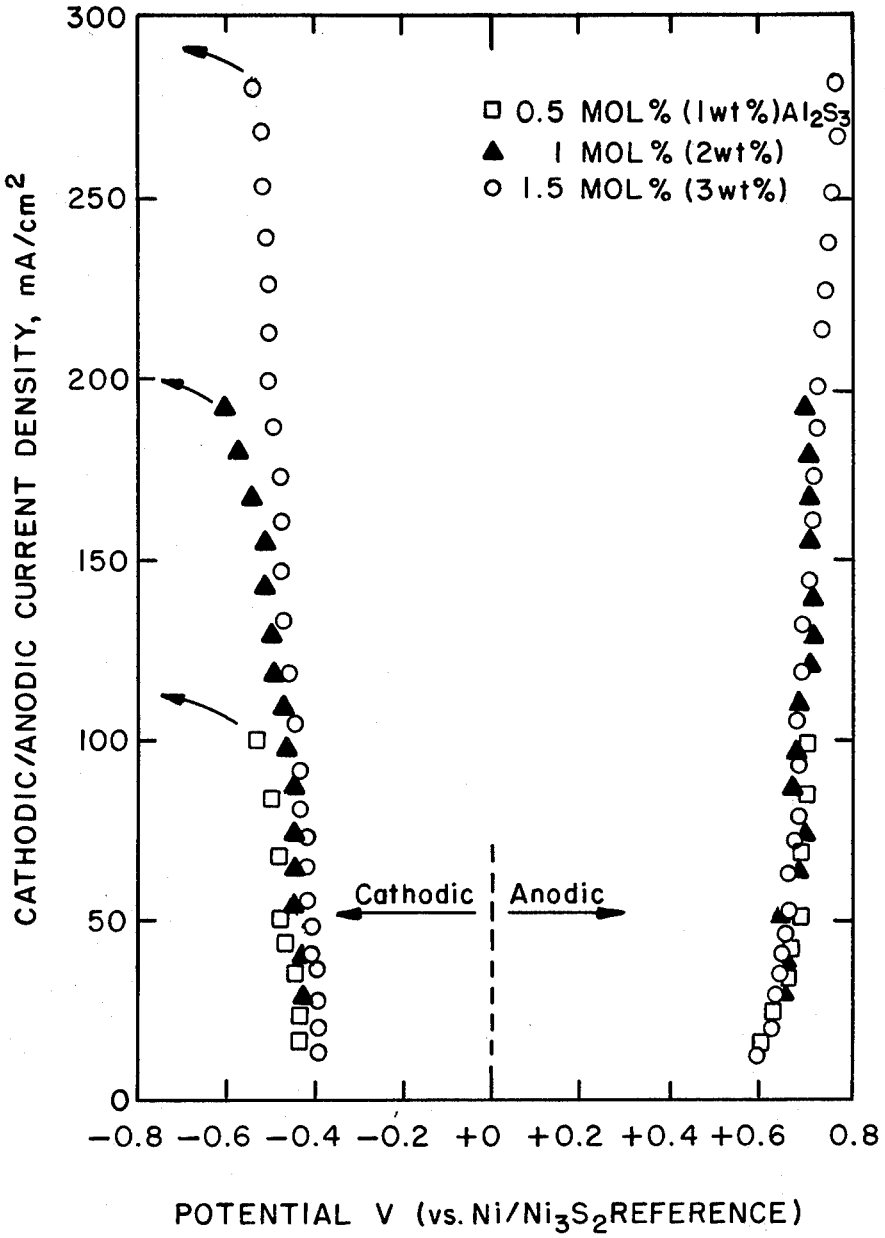
FIG. 1 is a graph of the relative potential in volts at each electrode (compared to a $Ni/Ni_3S_2$ reference) versus current density in electrolysis processes of the invention.

The process includes the step of conducting electrolysis of the bath at a temperature in the order of 700°–800° C. and preferably about 750° C., a cell voltage below about 3.0 volts and preferably about 2.0–2.5 volts and a current density above about 0.2 A/cm$^2$, and preferably above about 0.5 A/cm$^2$. During the electrolysis, metallic aluminum forms in a molten pool at the bottom of the cell and is removed. A sulfur containing gas is also formed at the operating temperatures and is removed. In the process a portion of the aluminum chloride may vaporize and be removed with the sulfur containing gas. However, the concentration of aluminum chloride may be maintained within desirable limits by separating the aluminum chloride from the sulfur containing gas and recycling aluminum chloride into the bath. As the electrolysis is carried out, the concentration of aluminum sulfide will be reduced and additional amounts will be added to maintain the desired concentration. Preferably, aluminum chloride is present in the bath to increase the concentration of aluminum and reduce the possibility that a second metal such as magnesium would be formed at the higher current densities obtainable with this process. As shown in FIG. 1, the current density of the process is limited by the aluminum concentration with the concentration of the sulfide permitting a higher current density before chlorine gas is formed. Higher current densities are beneficial since higher current efficiencies usually result and the rate of production of metallic aluminum is also increased.

For the following examples, the electrolysis was carried out in a cell constructed of two rectangular graphite plate electrodes sized approximately 5.0 cm by 12.7 cm by 0.95 cm (ATJ grade from Union Carbide) with the parallel distance between the electrodes being about 3 cm as determined by a boron nitride spacer (HP grade from Carborundum). Electrical connection to the graphite plates was made by molybdenum rods having a diameter about 0.63 cm. The electrodes were immersed from above in the molten bath contained in an alumina crucible of about 9.3 cm in diameter by 16.7 cm high (from Coors Porcelain).

Molten aluminum produced at the cathode was collected in a boron nitride collector which was placed directly under the cathode and could be raised by two molybdenum rods. A hood made of molybdenum was placed over the anode. Sulfur gas generated at the anode during the electrolysis passed into the hood and condensed on cold portions of the hood. A Lava radiation shield from the American Lava Corporation was used to reduce the amount of radiation heat loss. A chromel-alumel thermocouple inside an alumina sheath was inserted into the cell to monitor the actual temperature of the molten salt. The tests were carried out at a temperature of about 750° C.

The following examples are provided for illustration purposes and should not be construed as being restrictive with respect to the scope of the invention.

EXAMPLE I

An electrolysis of $Al_2S_3$ at concentrations of about 0.5 mol (1 wt. %), 1 mol (2 wt. %), and 1.5 mol (3 wt. %) was carried out in a molten bath with the results shown in FIG. 1. Current was fed to the cell by means of a power supply (SRL Model 20-25). The molten bath was a purified NaCl-KCl-$MgCl_2$ eutectic (about 30-20-50 mol % from Anderson Physics Laboratories). The electrolysis was carried out inside a helium-atmosphere glove box (VAC Dri-Lab and MO-40 Purification Systems) maintained at less than 5 ppm contaminants. Current densities at each concentration were increased as shown in FIG. 1.

For each $Al_2S_3$ concentration, the cathodic and anodic components of the cell voltage were measured against a Ni/$Ni_3S_2$ reference electrode at different current densities. The cathodic yield was determined by weighing the amount of aluminum collected in the cathode compartment after stopping the electrolysis. Sulfur was detected as the anode product although no attempt was made to collect the sulfur to determine the anodic efficiency. Other operating parameters for the electrolysis are salt charge, 350–450 g; electrolysis time, 0.5–2 hours; electrode area, 20–25 $cm^2$; electrode spacing, 3 cm; and aluminum recovered, 0.5–2 g.

In FIG. 1, the cathodic and anodic components of the steady-state cell voltage, uncorrected for ohmic drop, were plotted versus the anode/cathode current density at three $Al_2S_3$ concentration. For each $Al_2S_3$ concentration, the cathodic voltage increased with increasing current density until a limiting cathodic current density was reached when the voltage rose much more rapidly. The cathodic voltage varied rapidly toward more negative values near the limiting cathodic current density and no steady-state values could be measured (as shown by arrows in FIG. 1). No such rapid rise was observed for the anodic voltage up to the limiting cathodic current density. This rapid rise of the cathodic voltage was due to the reaching of the diffusion-limited rate for depsoition of aluminum ions (or aluminum-ion containing species) during the electrolysis.

As shown in FIG. 1, the higher current densities for the process were limited by the aluminum concentration since current densities in the order of 0.2 $A/cm^2$ were possible at 1 mol % without the generation of chlorine gas. For the melt containing $MgCl_2$, current densities above about 0.2 $A/cm^2$ for an aluminum concentration of about 1 mol % tend to generate metallic magnesium which will contaminate the metallic aluminum. As the aluminum concentration is increased by the addition of aluminum chloride, increased current densities may be utilized without the formation of metallic magnesium and to result in an increased rate of metallic aluminum formation.

EXAMPLE II

Electrolysis of $Al_2S_3$ at a concentration of about 1 mol % was carried out in a chloride melt composed of a NaCl-KCl-$MgCl_2$ eutectic at current densities between about 0.08–0.20 $A/cm^2$. The current efficiency for each run was calculated with the weight of aluminum produced by electrolysis. The general conditions and the results are shown in Table I and in FIG. 2.

Figure 2:
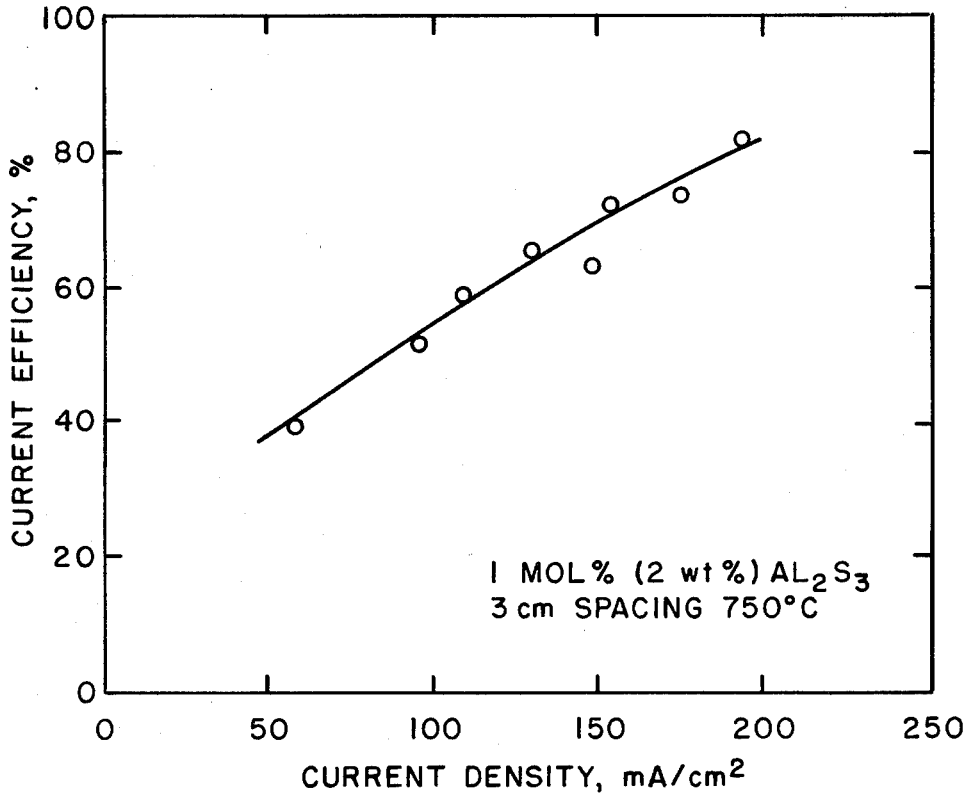
FIG. 2 is a graph of current density versus current efficiency for an electrolysis process utilizing aluminum sulfide at a concentration of about 1 mol % with current densities ranging between about 0.08–0.20 A/cm$^2$.

As indicated in FIG. 2, the current efficiency for the electrolysis of 1 mol % $Al_2S_3$ in a chloride melt increases with current density with desirable values of about 80% appearing when the current density reaches about 0.2 $A/cm^2$.

EXAMPLE III

An electrolysis of $Al_2S_3$ was carried out in a chloride melt composed of NaCl-KCl-$MgCl_2$ eutectic, about 5.7 mol % $AlCl_3$, and about 2.7 mol % $Al_2S_3$ at different current densities. The cathode's current efficienty was calculated from the weight of the aluminum produced by the electrolysis. Sulfur was detected as an anode product. Conditions and results from the tests are shown in Table II and in FIG. 3.

Figure 3:
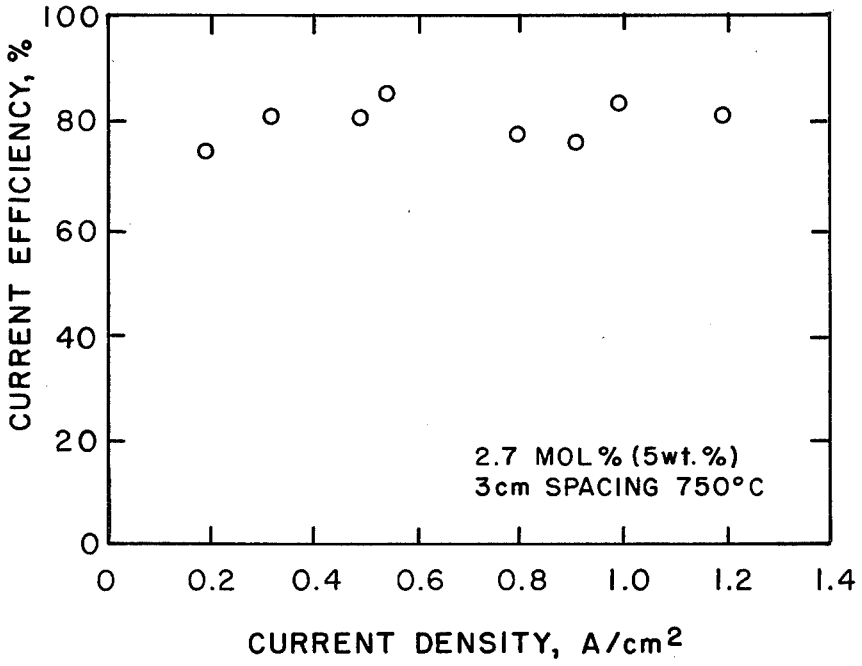
FIG. 3 is a graph of current density versus current efficiency for an electrolysis process utilizing aluminum sulfide at a concentration of about 2.7 mol % with current densities ranging between about 0.2–1.2 A/cm$^2$.

As indicated in Table II and in FIG. 3, the electrolysis may be carried out at current densities between 0.2 $A/cm^2$–1.2 $A/cm^2$ with current efficiencies being in the range of 75–85%.

TABLE I

Operating Parameters for the Production of Aluminum from $Al_2S_3$ Dissolved in $MgCl_2$—NaCl—KCl Eutectic

| Melt Composition | Run 1 $MgCl_2$—NaCl—KCl eutectic 1 mol % (2 wt. %) $Al_2S_3$ | Run 2 $MgCl_2$—NaCl—KCl eutectic 1 mol % (2 wt. %) $Al_2S_3$ |
|---|---|---|
| Charge | 390 g salt | 375 g salt |
| Temperature | 750° C. | 750° C. |

TABLE I-continued

Operating Parameters for the Production of Aluminum from $Al_2S_3$ Dissolved in $MgCl_2$—NaCl—KCl Eutectic

| Melt Composition | Run 1 $MgCl_2$—NaCl—KCl eutectic 1 mol % (2 wt. %) $Al_2S_3$ | Run 2 $MgCl_2$—NaCl—KCl eutectic 1 mol % (2 wt. %) $Al_2S_3$ |
|---|---|---|
| Cathode | graphite, 21.1 $cm^2$ | graphite, 20.9 $cm^2$ |
| Anode | graphite, 21.1 $cm^2$ | graphite, 20.9 $cm^2$ |
| Electrode spacing | 3 cm | 3 cm |
| Cell current | 4.10 A | 3.10 A |
| Cathode current density | 194 $mA/cm^2$ | 148 $mA/cm^2$ |
| Cell voltage | 1.52–1.65 V | 1.40–1.55 V |
| Faradays | 20,910 coulombs | 10,044 coulombs |
| Aluminum recovered | 1.60 g | 0.59 g |
| Cathode current efficiency | 82% | 63% |

TABLE II

Operating Parameters for the Electrolysis of $Al_2S_3$ in $MgCl_2$—NaCl—KCl Eutectic + 5.7 mol % (10 wt. %) $AlCl_3$

| $Al_2S_3$ Concentration | Run 1 2.7 mol % (5 wt. %) | Run 2 2.7 mol % (5 wt. %) |
|---|---|---|
| Salt charge (eutectic + $AlCl_3$) | 400 g | 368 g |
| Temperature | 750° C. | 750° C. |
| Cathode | graphite, 18.1 $cm^2$ | graphite, 16.7 $cm^2$ |
| Anode | graphite, 18.1 $cm^2$ | graphite, 16.7 $cm^2$ |
| Electrode spacing | 3 cm | 3 cm |
| Cell current | 10 A | 20 A |
| Anode/Cathode current density | 0.55 $A/cm^2$ | 1.20 $A/cm^2$ |
| Cell voltage | ~2.2 V | ~3.4 V |
| Faradays | 48,060 | 36,000 |
| Aluminum recovered | 3.81 g | 2.72 g |
| Cathodic current efficiency | 85% | 81% |

While the cell voltage was about 3.4 V and the current density was about 1.20 $A/cm^2$ for Run 2, the current efficiency was about 81% and the operation was carried out below the magnesium depositing current density as indicated in FIG. 1 for concentrations of $Al_2S_3$ above about 0.5–1 mol %.

The foregoing description of embodiments of the invention has been presented for purposes of illustration and description. It is not intended to be exhaustive or to limit the invention to the precise form disclosed and obviously many modifications and variations are possible in view of the above teachings.

The embodiments of the invention in which an exclusive property or privilege is claimed are defined as follows:

1. A process for producing metallic aluminum and elemental sulfur in an electrolytic cell, comprising forming a molten bath from about 2–10 mol % of aluminum sulfide, one or more alkali metal chlorides, and a chloride component composed of a mixture of an alkaline earth metal chloride present in an amount of about 20–70 mol % and aluminum chloride present in an amount of about 1–10 mol %, conducting electrolysis of the bath at a temperature in the order of 700°–800° C. to produce metallic aluminum and elemental sulfur, the electrolysis being conducted at a cell voltage of about 2.0–3.0 volts and a current density above about 0.2 $A/cm^2$, and adding additional aluminum sulfide to the bath during the electrolysis to maintain a concentration of aluminum in the bath at about 2–10 mol %.

2. The process of claim 1 wherein the alkaline earth metal chloride is magnesium chloride.

3. The process of claim 2 wherein the alkali metal chloride is a mixture of sodium chloride and potassium chloride and the amount of magnesium chloride is about 40–60 mol %.

4. The process of claim 1 wherein the chloride component includes aluminum chloride and the electrolysis is carried out at a current density below a value at which a metallic alkaline earth metal will form in the bath.

5. The process of claim 4 wherein the aluminum chloride is added to provide an aluminum concentration in the bath at least equal to the concentration of aluminum from aluminum sulfide.

6. A bath for use in the electrolytic production of metallic aluminum and composed of about 2–10 mol % of $Al_2S_3$, about 20–60 mol % of one or more alkali metal chlorides, and a chloride component composed of a mixture of an alkaline earth metal chloride present in an amount of about 20–70 mol % and aluminum chloride present in an amount of about 1–10 mol %.

7. The bath of claim 6 wherein the alkali metal is a mixture of sodium and potassium chlorides and the alkaline earth metal chloride is magnesium chloride.

8. The bath of claim 7 wherein the chlorides of the alkali metal and alkaline earth metal are present in amounts to form a low melting eutectic.

* * * * *